US005725604A

United States Patent [19]

Fritzsche et al.

[11] Patent Number: 5,725,604

[45] Date of Patent: *Mar. 10, 1998

[54] THERMOFIXING OF DYES IN PRESENCE OF POLYMERIZABLE COMPOUND AND AN INITIATOR

[75] Inventors: Katharina Fritzsche, Weil am Rhein, Germany; Alex Känzig, Therwil, Switzerland

[73] Assignee: Ciba Specialty Chemicals Corporation, Tarrytown, N.Y.

[ * ] Notice: The term of this patent shall not extend beyond the expiration date of Pat. No. 5,679,115.

[21] Appl. No.: 615,226

[22] PCT Filed: Sep. 5, 1994

[86] PCT No.: PCT/EP94/02955

§ 371 Date: Mar. 14, 1996

§ 102(e) Date: Mar. 14, 1996

[87] PCT Pub. No.: WO95/08018

PCT Pub. Date: Mar. 23, 1995

[30] Foreign Application Priority Data

Sep. 16, 1993 [CH] Switzerland ..... 02 788/93

[51] Int. Cl.[6] ..... D06P 1/52; D06P 1/66

[52] U.S. Cl. ..... 8/543; 8/405; 8/523; 8/554; 8/602; 8/606; 8/618; 8/630; 8/917; 8/918; 8/922; 8/924; 8/926; 8/928; 8/933

[58] Field of Search ..... 8/606, 554, 543, 8/405, 523, 602, 618, 639, 917–933

[56] References Cited

U.S. PATENT DOCUMENTS

| | | | |
|---|---|---|---|
| 4,678,474 | 7/1987 | Ueda et al. | 8/543 |
| 5,147,411 | 9/1992 | Topfl | 8/606 |
| 5,230,711 | 7/1993 | Keil et al. | 8/652 |
| 5,238,465 | 8/1993 | Fritzsche | 8/444 |
| 5,409,504 | 4/1995 | Fritzsche | 8/444 |

FOREIGN PATENT DOCUMENTS

| | | |
|---|---|---|
| 0466648 | 1/1992 | European Pat. Off. . |

OTHER PUBLICATIONS

Chemical Abstracts, 95: 205340U (JP A–56–096976).

AATCC Technical Manual–Test Method 61–1994 pp. 94–97 (1995).

*Primary Examiner*—Margaret Einsmann
*Attorney, Agent, or Firm*—David R. Crichton; Kevin T. Mansfield

[57] ABSTRACT

The present invention relates to a process for dyeing or printing organic material, which comprises applying at last one dye selected from those containing a chromophore radical from the monoazo, polyazo, metal complex azo, anthraquinone, phthalocyanine, formazan, azomethine, nitroaryl, dioxazine, phenazine, stilbene, triphenylmethane, xanthene, thioxanthone, naphthoquinone, pyrenequinone or perylenetetracarbamide series which contains an acrylamide, methacrylamide, bromoacrylamide or chloroacrylamide reactive group, at least one colourless cationic compound containing at least one polymerizable double bond, and at least one polymerization initiator and then subjecting it to thermofixation. Further auxiliaries to the organic material may optionally may optionally be included.

26 Claims, No Drawings

THERMOFIXING OF DYES IN PRESENCE OF POLYMERIZABLE COMPOUND AND AN INITIATOR

The invention relates to a process for fixing dyes on organic materials by means of at least one colourless cationic compound containing at least one polymerizable double bond and at least one polymerization initiator by thermally initiated polymerization.

It is known that dyes, preferably those containing reactive groups, can be fixed on organic material, in particular on fibre material, by thermofixing.

The practice of dyeing, in particular, with reactive dyes but also with direct dyes has recently led to increased demands on the quality of dyeing and the economy and ecology of the dyeing process. In many cases, fixing of direct and reactive dyes carried out by conventional methods does not meet these demands. As a result, the object of the present invention is to provide an improved process for fixing which can achieve high degrees of fixation and an economically and ecologically optimum dyeing process.

It has now been found that this object can be achieved by the inventive process described below.

Accordingly, the present invention provides a process for dyeing or printing organic material, in particular fibre material, which comprises applying at least one dye, at least one colourless cationic compound containing at least one polymerizable double bond, and at least one polymerization initiator, and, if desired, further auxiliaries to the organic material, in particular fibre material, and then subjecting it to thermofixing.

The process according to the invention is distinguished by the fact that, for example, the dye can be applied together with a colourless cationic compound and a polymerization initiator, and, if desired, further auxiliaries, so that only a single dyeing vat or only a single dyeing liquor or printing paste is necessary and a substantially higher degree of fixation is achieved than in the known processes in which no colourless cationic polymerizable compound is used. It is however also possible to apply the colourless cationic compound, the polymerization initiator and also further auxiliaries, if used, separately after the actual dyeing process and then subjecting them to thermofixing.

The process according to the invention significantly reduces the use of auxiliaries and waste water since, for example, after the fixation process according to the invention, no fixing alkali has to be washed off but the dyed or printed fibre material only needs to be dried and possibly rinsed for a short period of time.

Fixing according to the invention is carried out, for example, by subjecting an organic fibre material, for example a textile fibre material, after the treatment with a dye in the presence of a colourless cationic compound containing at least one polymerizable double bond and a polymerization catalyst, and, if desired, further auxiliaries to a thermal treatment for a short period of time while it is wet, moist or dry. The treatment of the organic fibre material with a dye according to the definition can be carried out in one of the usual ways, for example in the case of textile fabric by impregnation with a dye solution in an exhaust bath or by applying a padding solution by spraying or by pad-dyeing, or by printing it, for example, in a roller printing machine or film printing machine or by means of the ink-jet printing technique.

The polymerization initiators added in the process according to the invention are inorganic or organic peroxides or aliphatic azo compounds which are activated by the heat generated during the thermal treatment and initiate the polymerization.

Examples of such polymerization initiators include, for example, 4,4'-azobis(4-cyanopentanoic acid), α,α'-azobis (butyronitrile), azoamides, for example azobis[2-methyl-(1,1-dimethyl-2-hydroxyethyl)propionamide], 2,2'-azobis(2-methylpropiohydroxamic acid), 2,2'-azobis[2-(N-phenylamidino)propane dihydrochloride], 2,2'-azobis(2-methylpropionohydrazide), 2,2'-azobis(N,N-dimethyleneisobutylamidine), 2,2'-azobis(2-amidinopropane dihydrocbloride), organic peroxides, for example chloroacetyl peroxide, trichloroacetyl peroxide, benzoyl peroxide, chlorobenzoyl peroxide, benzoyl acetyl peroxide, propionyl peroxide, fluorochloropropionyl peroxide, lauryl peroxide, cumene hydroperoxide, cyclohexanone hydroperoxide, tert-butyl hydroperoxide, di-tert-butyl peroxide, di-ten-amyl peroxide and p-methane hydroperoxide, and also inorganic peroxide compounds, such as hydrogen peroxide, sodium peroxide, alkali metal percarbonates, alkali metal peroxodisulfates or alkali metal perborates, and redox systems known from the relevant literature. The amount of catalysts to be added depends in a known manner on the desired course of the reaction or the desired properties of the polymer. Advantageously, about 0.005 to 20% by weight, relative to the total amount of polymerizable colourless compounds, are used.

Preferred polymerization initiators are 2,2'-azobis(2-methylpropiohydroxamic acid), 2,2'-azobis(2-methylpropionohydrazide), 2,2'-azobis(2-amidinopropane dihydrochloride), 2,2'-azobis[2-(N-phenylamidino)propane dihydrochloride], and sodium perborate.

Preference is given in particular to compounds from the group consisting of alkali metal peroxodisulfates, in particular sodium peroxodisulfate and potassium peroxodisulfate, ammonium peroxodisulfate, sodium percarbonate and 4,4'-azobis(4-cyanopentanoic acid).

Thermofixing can be carried out in various ways, for example by steaming, high-temperature steaming, thermofixing, microwave or high-frequency treatment. In the process according to the invention, preference is given to the use of thermofixing.

The temperature range in the process according to the invention is between 70° and 230° C., preferably between 70° and 180° C., in particular between 90° and 160° C.

The duration of the thermal treatment depends on the substrate to be dyed, the dye used, the temperature selected and, in particular, on the type of initiator. It is usually 1 to 10 minutes, preferably 1 to 5 minutes.

The dyes suitable for this fixing process include those whose chromophoric systems belong to a wide range of groups, for example the monoazo or polyazo, metal complex azo, anthraquinone, phthalocyanine, formazan, azomethine, nitroaryl, dioxazine, phenazine, stilbene, triphenylmethane, xanthene, thioxanthone, naphthoquinone, pyrenequinone or perylenetetracarbimide series.

Examples of particularly suitable dyes are the direct dyes and the reactive dyes.

Direct dyes are understood as meaning, for example, those dyes described in Colour Index, 3rd Edition (3rd Revision 1987, including Additions and Amendments up to No. 85) as "direct dyes".

Reactive dyes are understood as meaning those dyes containing one or more reactive groups. They are understood as meaning those dyes described in Colour index, 3rd Edition (3rd Revision 1987, including Additions and Amendments up to No. 85) as "reactive dyes".

Reactive groups are understood as meaning fibre-reactive radicals which are capable of reacting with the hydroxyl groups of cellulose, the amino, carboxyl, hydroxyl and mercapto groups of wool and silk, or with the amino and, if present, carboxyl groups of synthetic polyamides with the formation of covalent chemical bonds. The reactive groups are usually attached to the dye radical directly or via a bridging member. Examples of suitable reactive groups are those containing at least one detachable substituent on an aliphatic, aromatic or heterocyclic radical or in which the radicals mentioned contain a radical capable of reacting with the fibre material, for example a triazine radical. Examples of reactive groups include radicals containing carbo- or heterocyclic 4-, 5- or 6-membered rings substituted by a detachable atom or a detachable group. Examples of heterocyclic radicals include those containing at least one detachable substituent attached to a heterocyclic radical; they include those containing at least one reactive substituent attached to a 5- or 6-membered heterocyclic ring, such as to a monoazine, diazine, triazine, pyridine, pyrimidine, pyridazine, pyrazine, thiazine, oxazine or unsymmetrical or symmetrical triazine ring, or to such a ring system containing one or more fused-on aromatic rings, such as a quinoline, phthalazine, cinnoline, quinazoline, quinoxaline, acridine, phenazine and phenanthridine ring system. Furthermore, the heterocyclic fibre-reactive radicals mentioned can contain further fibre-reactive radicals, for example the abovementioned radicals, via a direct bond or via a bridging member.

Particularly preferred reactive groups are those containing at least one activated unsaturated group, in particular an unsaturated aliphatic group, for example a vinyl, halovinyl, styryl, acrylic or methacrylic group, or at least one polymerizable ring system. Examples of such groups include unsaturated groups containing halogen atoms, such as halomaleic acid and halopropiolic acid radicals, α- or β-bromo- or chloroacrylic groups, halogenated vinylacetyl groups, halocrotonic or halomethacrylic groups. Also suitable are groups which can be easily converted into halogen-containing unsaturated groups, for example by elimination of hydrogen halide, for example the dichloro- or dibromopropionyl group. Here halogen atoms are understood as meaning fluorine, chlorine, bromine and iodine atoms and also pseudohalogen atoms, for example the cyano group. The process according to the invention also gives good results with dyes containing an α-bromoacrylic group. Dyes containing a polymerizable double bond are preferably those containing at least one acryloyl, methacryloyl, α-bromoacryloyl, α-chloroacryloyl, vinyl or vinylsulfonyl radical; particular preference is given to those containing at least one acrylamido, methacrylamido, bromoacrylamido and chloroacrylamido reactive group and very particular preference is given to those containing, independently of one another, at least two acrylamido, methacrylamido, bromoacrylamido and chloroacrylamido reactive groups. Dyes containing a polymerizable ring system are preferably those containing at least one epoxy radical.

Examples of other detachable atoms or detachable groups are ammonium, including hydrazinium, sulfato, thiosulfato, phosphato, acetoxy, propionoxy or carboxypyridinium.

Suitable bridging members between the dye radical and the fibre-reactive radical or suitable bridging members between two fibre-reactive radicals are, in addition to the direct bond, a wide range of radicals. The bridging member is, for example, an aliphatic, aromatic or heterocyclic radical; furthermore, the bridging member can also be composed of various such radicals. The bridging member usually contains at least one functional group, for example a carbonyl group or an amino group, where the amino group can be further substituted by unsubstituted or halogen-, hydroxyl-, cyano-, $C_1$–$C_4$alkoxy-, $C_1$–$C_4$alkoxycarbonyl-, carboxyl-, sulfamoyl-, sulfo- or sulfato-substituted $C_1$–$C_4$alkyl. An example of a suitable aliphatic radical is an alkylene radical having 1 to 7 carbon atoms or branched isomers thereof. The carbon chain of the alkylene radical may be interrupted by a heteroatom, for example an oxygen atom. An example of a suitable aromatic radical is a phenyl radical which may be substituted by $C_1$–$C_4$alkyl, for example methyl or ethyl, $C_1$–$C_4$alkoxy, for example methoxy or ethoxy, halogen, for example fluorine, bromine or, in particular, chlorine, carboxyl or sulfo and an example of a suitable heterocyclic radical is a piperazine radical. Examples of such bridging members are the following radicals:

$-CO-N(R_1)-(CH_2)_{2-3}-$;

$-CO-N(R_1)-(CH_2)_2-O-(CH_2)_2-$;

$-N(R_1)-CO-(CH_2)_3-$; $-N(R_1)-$;

$-N(R_1)-(CH_2)_2-O-(CH_2)_2-$; $-O-(CH_2)_2-$;

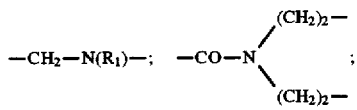

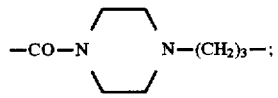

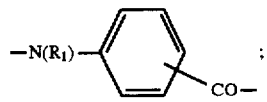

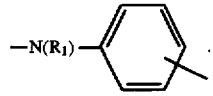

In the abovementioned formulae, $R_1$ is hydrogen or $C_1$–$C_4$alkyl which may be substituted by halogen, hydroxyl, cyano, $C_1$–$C_4$alkoxy, $C_1$–$C_4$alkoxycarbonyl, carboxyl, sulfamoyl, sulfo or sulfato.

Reactive groups which are of interest are 1,3,5-triazine radicals of the formula

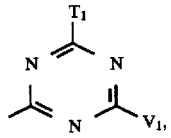

(1)

in which $T_1$ is fluorine, chlorine or carboxypyridinium and where the substituents $V_1$ on the triazine ring include in particular: fluorine, chlorine, $-NH_2$, $C_1$–$C_6$alkylamino, N,N-di-$C_1$–$C_6$alkylamino, cyclohexylamino, N,N-dicyclohexylamino, benzylamino, phenethylamino, phenylamino, naphthylamino, N-$C_1$–$C_6$alkyl-N-cyclohexylamino or N-$C_1$–$C_6$alkyl-N-phenylamino, or morpholino, piperidino, piperazino, hydrazino or semicarbazido, or an amino group substituted by a furan, thiophene, pyrazole, pyridine, pyrimidine, quinoline, benzimidazole, benzothiazole or benzoxazole radical. The alkyl, cycloalkyl, aralkyl and aryl radicals mentioned and the heterocyclic radicals can be further substituted as shown under formula (1).

$V_1$ in the radical of the formula (1) is particularly preferably fluorine, chlorine, phenylamino or N-$C_1$–$C_4$alkyl-N-phenylamino, where the phenyl rings are unsubstituted or substituted by halogen, such as fluorine, chlorine or bromine, nitro, cyano, trifluoromethyl, sulfamoyl, carbamoyl, $C_1$–$C_4$alkyl, $C_1$–$C_4$alkoxy, acylamino groups, such as acetylamino or benzoylamino, ureido, hydroxyl, carboxyl, sulfomethyl or, in particular, sulfo.

Fibre-reactive radicals which are of interest are, for example, those of the formula

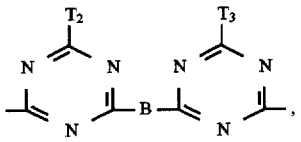

(2)

in which $T_2$ and $T_3$, independently of one another, are fluorine, chlorine or carboxypyridinium and B is a bridging member.

A suitable bridging member B is, for example, a radical of the formula

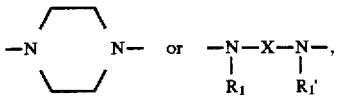

in which $R_1$ and $R_1'$ are, independently of one another, hydrogen or unsubstituted or halogen-, hydroxyl-, cyano-, $C_1$–$C_4$alkoxy-, $C_1$–$C_4$alkoxycarbonyl-, carboxyl-, sulfamoyl-, sulfo or sulfato-substituted $C_1$–$C_4$-alkyl and X is an unsubstituted or hydroxyl-, sulfo-, sulfato-, $C_1$–$C_4$alkoxy-, carboxyl- or halogen-substituted $C_2$–$C_6$alkylene or $C_5$–$C_9$cycloalkylene radical or an unsubstituted or $C_1$–$C_4$alkyl-, $C_1$–$C_4$alkoxy-, sulfo-, halogen- or carboxyl-substituted phenylene, biphenylene or naphthylene radical.

Further reactive groups which are of interest are those of the formula

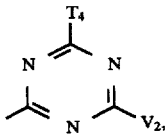

(3)

in which $T_4$ is fluorine, chlorine or carboxypyridinium and $V_2$ is a radical of the formula

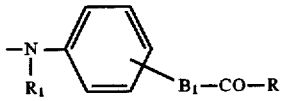

(4)

in which $R_1$ is hydrogen or $C_1$–$C_4$alkyl which may be substituted by halogen, hydroxyl, cyano, $C_1$–$C_4$alkoxy, $C_1$–$C_4$alkoxycarbonyl, carboxyl, sulfamoyl, sulfo or sulfato;

$B_1$ is a direct bond or a radical $-(CH_2)_n-$ or $-O-(CH_2)_n-$;

n is 1, 2, 3, 4, 5 or 6; and

R is a radical of the formula

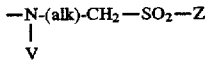

(4a)

-continued

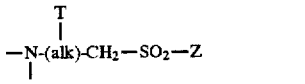

(4b)

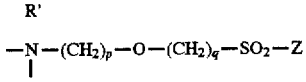

(4c)

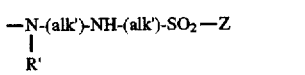

(4d)

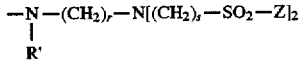

(4e)

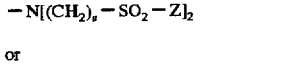

(4f)

or

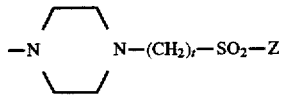

(4g)

in which R' is hydrogen or $C_1$–$C_6$alkyl, alk is an alkylene radical having 1 to 7 carbon atoms, T is hydrogen, halogen, hydroxyl, sulfato, carboxyl, cyano, $C_1$–$C_4$alkanoyloxy, $C_1$–$C_4$alkoxycarbonyl, carbamoyl or a radical $-SO_2-Z$, V is hydrogen, substituted or unsubstituted $C_1$–$C_4$alkyl or a radical of the formula

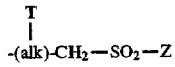

(4h)

in which (alk) is as defined above, the radicals alk' are, independently of one another, polymethylene radicals having 2 to 6 C atoms, Z is β-sulfatoethyl, β-thiosulfatoethyl, β-phosphatoethyl, β-acyloxyethyl, β-haloethyl, vinyl or

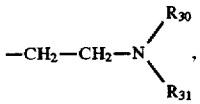

in which $R_{30}$ and $R_{31}$ are, independently of one another, hydrogen or $C_1$–$C_3$alkyl, which is unsubstituted or substituted by $SO_3H$, p, q, r and t are each, independently of one another, 1, 2, 3, 4, 5 or 6 and s is 2, 3, 4, 5 or 6; and the benzene ring in formula (4) may contain further substituents; or in which $V_2$ is a radical of the formula (4a), (4b), (4c), (4d), (4e), (4f) or (4g), which is directly attached to the triazine ring, in which R', T, alk, V, alk', Z, p, q, r, s and t are as defined; or in which $V_2$ is a radical of the formula

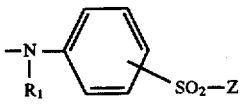

(4')

in which $R_1$ and Z are as defined above and the benzene ring may be further substituted.

Further possible substituents of the benzene rings of the compounds of the formulae (4) and (4') include halogen, such as fluorine, chlorine or bromine, nitro, cyano, trifluoromethyl, sulfamoyl, carbamoyl, $C_1$–$C_4$alkyl, $C_1$–$C_4$alkoxy, acylamino groups, such as acetylamino or benzoylamino, ureido, hydroxy, carboxyl, sulfomethyl and sulfo.

The radical $B_1$ contains 1 to 6, preferably 1 to 4, carbon atoms; examples of $B_1$ are: methylene, ethylene, propylene, butylene, methyleneoxy, ethyleneoxy, propyleneoxy and butyleneoxy. Where $B_1$ is a Rest $—O—(CH_2)_n—$, $B_1$ is attached to the benzene ring via an oxygen atom. Preferably, $B_1$ is a direct bond.

β-Haloethyl as Z is in particular a β-chloroethyl radical and β-acyloxyethyl as Z is in particular a β-acetoxyethyl radical. The alkylene radical alk is preferably methylene, ethylene, methylmethylene, propylene or butylene. The substituent T as alkanoyloxy radical is in particular acetyloxy, propionyloxy or butyryloxy, and as alkoxycarbonyl radical in particular methoxycarbonyl, ethoxycarbonyl or propyloxycarbonyl. V as an alkyl radical can be methyl, ethyl, propyl, isopropyl, butyl, isobutyl, sec-butyl or tert-butyl. Examples of the radical R' are methyl, ethyl, propyl, isopropyl, butyl, isobutyl, sec-butyl, tert-butyl, pentyl or hexyl, or preferably hydrogen. The polymethylene radicals alk' are preferably ethylene, propylene or butylene. The indices p, q and t are, independently of one another, preferably 2, 3 or 4. The indices r and s are, independently of one another, preferably 2.

Preferred radicals $V_2$ are those of the formula (4), in which $B_1$ is a direct bond and R is a radical of the formula (4a), or in which $V_2$ is a radical of the formula (4b), (4c) or (4f) which is directly attached to the triazine ring, or in which $V_2$ is a radical of the formula (4').

Preferred aliphatic reactive groups are those of the formulae $$—SO_2Z, \quad (5a)$$

$$—SO_2—NH—Z, \quad (5b)$$

$$—NH—CO—(CH_2)_3—SO_2Z, \quad (5c)$$

$$—CO—NH—CH_2CH_2—SO_2Z \quad (5d)$$

and $$—NH—CO—Z_1, \quad (5e)$$

in which Z is as defined above, $Z_1$ has the meanings of Z and can additionally be α,β-dihaloethyl or halovinyl.

For $Z_1$, suitable halogens in the β-haloethyl and α,β-dihaloethyl groups are in particular chlorine and bromine.

Particularly preferred aliphatic reactive groups are those of the formula (5a) and furthermore those of the formulae (5c) and (5d). For these radicals, Z is in particular β-sulfatoethyl or β-haloethyl.

Very particularly preferably, the reactive dyes contain at least one reactive group of the formulae (1), (2), (3) and (5a) to (5e), where $T_1$, $T_2$, $T_3$, $T_4$, $V_1$, $V_2$, B, Z and $Z_1$ have the abovementioned meanings and preferences.

The reactive dyes are derived, in particular, from the radical of a monoazo, polyazo, metal complex azo, anthraquinone, phthalocyanine, formazan, azomethine, dioxazine, phenazine, stilbene, triphenylmethane, xanthene, thioxanthone, nitroaryl, naphthoquinone, pyrenequinone or perylenetetracarbimide dye, preferably from the radical of a monoazo, disazo, metal complex azo, formazan, anthraquinone, phthalocyanine or dioxazine dye. As further substituents in addition to the reactive group, the reactive dyes can contain the substituents customary in organic dyes attached to their basic structure.

Examples of such further substituents of the reactive dyes include: alkyl groups having 1 to 4 carbon atoms, such as methyl, ethyl, propyl, isopropyl or butyl, alkoxy groups having 1 to 4 carbon atoms, such as methoxy, ethoxy, propoxy, isopropoxy or butoxy, acylamino groups having 1 to 8 carbon atoms, in particular alkanoylamino groups and alkoxycarbonylamino groups, such as acetylamino, propionylamino, methoxycarbonylamino, ethoxycarbonylamino or benzoylamino, phenylamino, N,N-di-β-hydroxyethylamino, N,N-di-β-sulfatoethylamino, sulfobenzylamino, N,N-disulfobenzylamino, alkoxycarbonyl having 1 to 4 carbon atoms in the alkoxy radical, such as methoxycarbonyl or ethoxycarbonyl, alkylsulfonyl having 1 to 4 carbon atoms, such as methylsulfonyl or ethylsulfonyl, trifluoromethyl, nitro, cyano, halogen, such as fluorine, chlorine or bromine, carbamoyl, N-alkylcarbamoyl having 1 to 4 carbon atoms in the alkyl radical, such as N-methylcarbamoyl or N-ethylcarbamoyl, sulfamoyl, N-alkylsulfamoyl having 1 to 4 carbon atoms, such as N-methylsulfamoyl, N-ethylsulfamoyl, N-propylsulfamoyl, N-isopropylsulfamoyl or N-butylsulfamoyl, N-(β-hydroxyethyl)sulfamoyl, N,N-di-(β-hydroxyethyl) sulfamoyl, N-phenylsulfamoyl, ureido, hydroxyl, carboxyl, sulfomethyl or sulfo and further fibre-reactive radicals. Preferably, the reactive dyes contain one or more sulfo groups.

The reactive dyes are preferably derived from the following dye radicals:

a) Dye radicals of a 1:1 copper complex azo dye from the benzene or naphthalene series where the copper atom is attached to one metallizable group each on both sides in the ortho position relative to the azo bridge.

b) Particular preference is given to the mono- or disazo dye radicals of the formula $$D_1—N=N—(M—N=N)_u—K—, \quad (6a)$$

$$—D_1—N=N—(M—N=N)_u—K \quad (6b)$$

or $$—D_1—N=N—(M—N=N)_u—K—, \quad (6c)$$

or of a metal complex derived therefrom;

$D_1$ is the radical of a diazo component from the benzene or naphthalene series, M is the radical of a middle component from the benzene or naphthalene series and K is the radical of a coupling component from the benzene, naphthalene, pyrazolone, 6-hydroxy-2-pyridone or acetoacetarylamide series where $D_1$, M and K can carry substituents customary in azo dyes, in particular hydroxyl, amino, methyl, ethyl, methoxy or ethoxy groups, substituted or unsubstituted alkanoylamino groups having 2 to 4 C atoms, substituted or unsubstituted benzoylamino groups, halogen atoms or a fibre-reactive radical, in particular a radical $—SO_2—Z$ where Z is β-sulfatoethyl, β-thiosulfatoethyl, β-phosphatoethyl, β-acyloxyethyl, β-haloethyl or vinyl; u is 0 or 1;

and $D_1$, M and K together contain at least one sulfo group, preferably three or four sulfo groups.

c) Particular preference is also given to the dye radicals of a disazo dye of the formula $$—D_1—N=N—K—N=N—D_2 \quad (7a)$$

or $$—D_1—N=N—K—N=N—D_2—, \quad (7b)$$

in which $D_1$ and $D_2$ are, independently of one another, the radical of a diazo component from the benzene or naphthalene series and K is the radical of a coupling component from the naphthalene series;

where $D_1$, $D_2$ and K can carry substituents customary in azo dyes, in particular hydroxyl, amino, methyl, ethyl, methoxy or ethoxy groups, substituted or unsubstituted alkanoylamino groups having 2 to 4 C atoms, substituted or unsubstituted benzoylamino groups, halogen atoms or a fibre-reactive radical, in particular a radical $—SO_2—Z$ where Z is as defined and $D_1$, $D_2$ and K together contain at least two sulfo groups, preferably three or four sulfo groups.

Of importance are d) dye radicals of a formazan dye of the formula (8a)

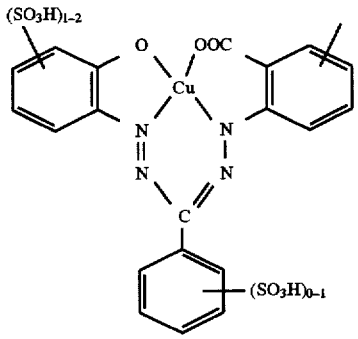

or (8b)

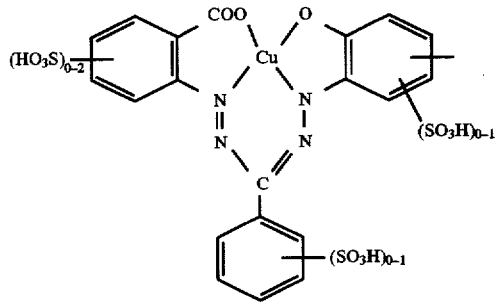

(8c)

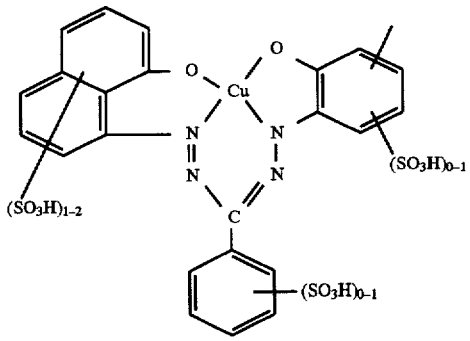

or

-continued (8d)

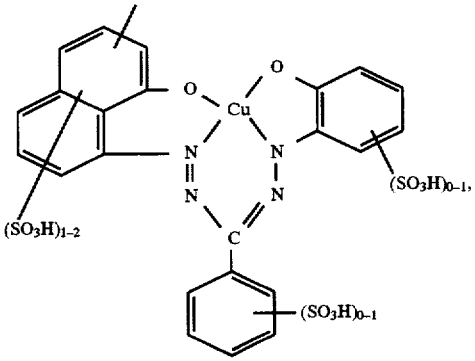

in which the benzene rings can furthermore be substituted by alkyl having 1 to 4 C atoms, alkoxy having 1 to 4 C atoms, alkylsulfonyl having 1 to 4 C atoms, halogen or carboxyl.

e) Dye radicals of an anthraquinone dye of the formula (9)

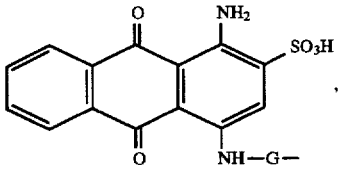

in which G is a phenylene, cyclohexylene, phenylenemethylene or $C_2$–$C_6$alkylene radical; where the anthraquinone ring can be substituted by a further sulfo group and G as phenyl radical can be substituted by alkyl having 1 to 4 C atoms, alkoxy having 1 to 4 C atoms, halogen, carboxyl or sulfo, and the dye preferably contains at least two sulfo groups.

f) Dye radicals of a phthalocyanine dye of the formula (10)

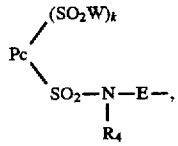

in which Pc is the radical of a copper phthalocyanine or nickel phthalocyanine;

W is —OH and/or $—NR_5R_5$;

$R_5$ and $R_5$ are, independently of one another, hydrogen or alkyl having 1 to 4 carbon atoms which can be substituted by hydroxyl or sulfo;

$R_4$ is hydrogen or alkyl having 1 to 4 carbon atoms;

E is a phenylene radical which can be substituted by alkyl having 1 to 4 C atoms, halogen, carboxyl or sulfo; or is an alkylene radical having 2 to 6 C atoms, preferably a sulfophenylene or ethylene radical;

and k is 1, 2 or 3.

Dye radicals of a dioxazine dye of the formula (11a)

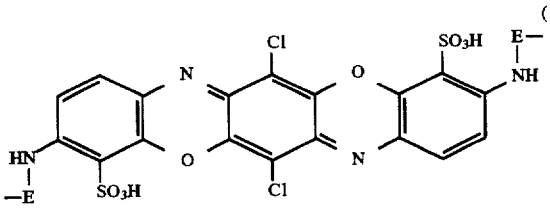

-continued or (11b)

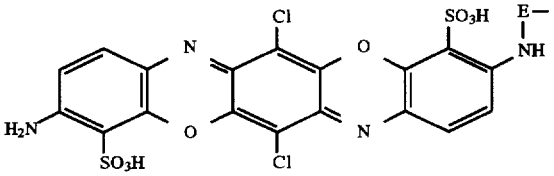

in which E is a phenylene radical which can be substituted by alkyl having 1 to 4 C atoms, halogen, carboxyl or sulfo; or is an alkylene radical having 2 to 6 C atoms; and the outer benzene rings in formulae (11a) and (11b) can be further substituted by alkyl having 1 to 4 C atoms, alkoxy having 1 to 4 C atoms, acetylamino, nitro, halogen, carboxyl, sulfo or $—SO_2—Z$, where Z is β-sulfatoethyl, β-thiosulfatoethyl, β-phosphatoethyl, β-acyloxyethyl, β-haloethyl, vinyl or

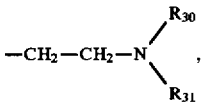

in which $R_{30}$ and $R_{31}$ are, independently of one another, hydrogen or $C_1$–$C_3$alkyl which is unsubstituted or substituted by $SO_3H$.

Dyes which are also particularly preferably used are those containing the radical of the formulae (12a) to (12j)

(12a)

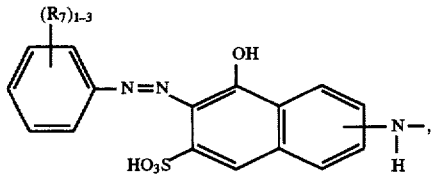

in which $(R_7)_{1-3}$ is 1 to 3 substituents from the group consisting of $C_{1-4}$alkyl, $C_{1-4}$alkoxy, halogen, carboxyl and sulfo;

(12b)

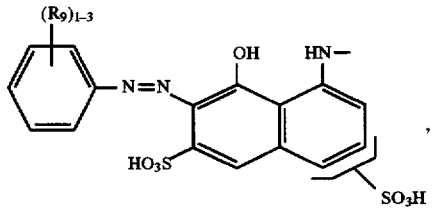

in which $(R_9)_{1-3}$ is 1 to 3 substituents from the group consisting of $C_{1-4}$alkyl, $C_{1-4}$alkoxy, halogen, carboxyl and sulfo;

(12c)

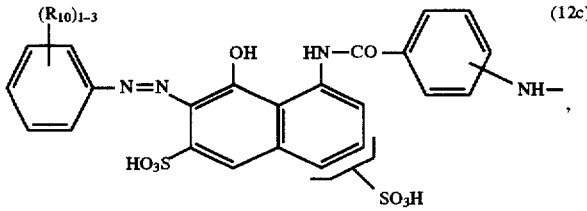

in which $(R_{10})_{1-3}$ is 1 to 3 substituents from the group consisting of $C_{1-4}$alkyl, $C_{1-4}$alkoxy, halogen, carboxyl and sulfo;

(12d)

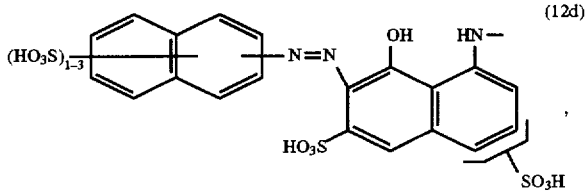

(12e)

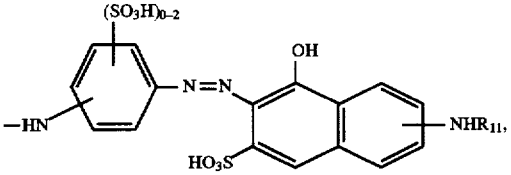

in which $R_{11}$ is $C_{2-4}$alkanoyl or benzoyl;

(12f)

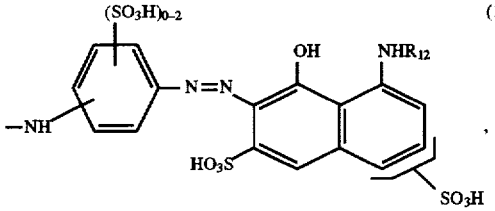

in which $R_{12}$ is $C_{2-4}$alkanoyl or benzoyl;

(12g)

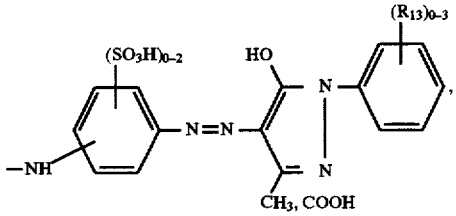

in which $(R_{13})_{0-3}$ is 0 to 3 substituents from the group consisting of $C_{1-4}$alkyl, $C_{1-4}$alkoxy, halogen, carboxyl and sulfo;

(12h)

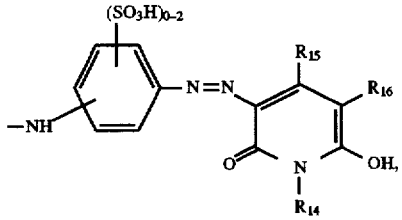

in which $R_{14}$ and $R_{15}$ are, independently of one another, hydrogen, $C_{1-4}$alkyl or phenyl, and $R_{16}$ is hydrogen, cyano, carbamoyl or sulfomethyl;

(12i)

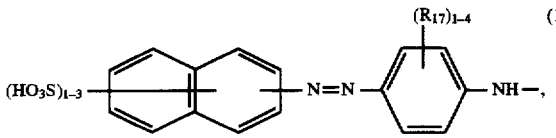

in which $(R_{17})_{1-4}$ is 1 to 4 substituents from the group consisting of hydrogen, halogen, nitro, cyano, trifluoromethyl, sulfamoyl, carbamoyl, $C_{1-4}$alkyl, $C_{1-4}$alkoxy, amino, acetylamino, ureido, hydroxyl, carboxyl, sulfomethyl and sulfo, these substituents being independent of one another; and

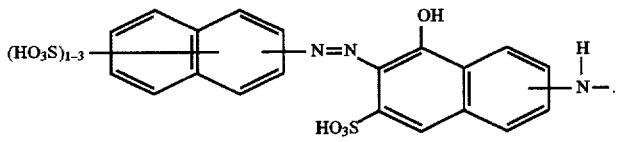
(12j)
Particular preference is given to dyes of the formula
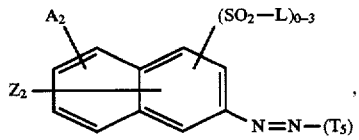
(14)
in which
L is OH or
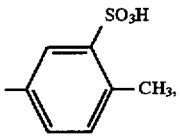
(15)
$A_2$ is hydrogen or $C_1$–$C_3$alkyl,
$T_5$ is a radical of the formula
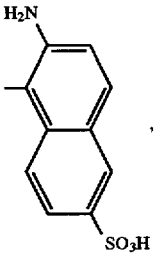
(16)
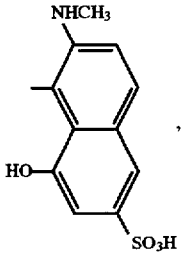
(17)
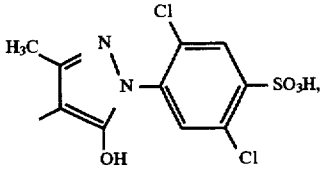
(18)
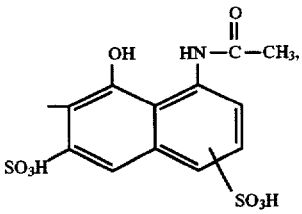
(19)
-continued
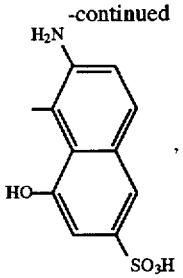
(20)
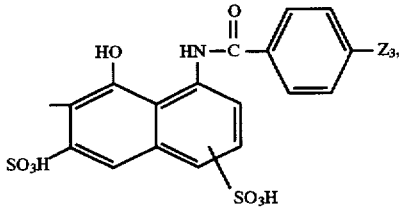
(21)
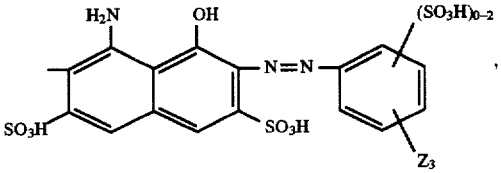
(22)
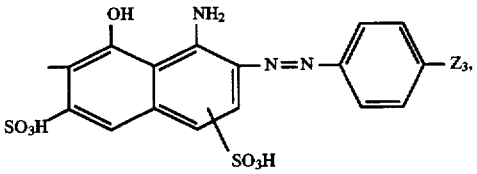
(23)
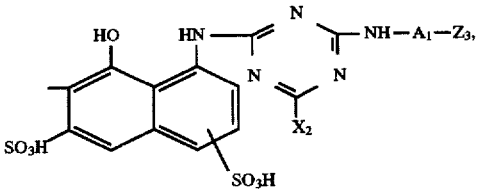
(24)
and
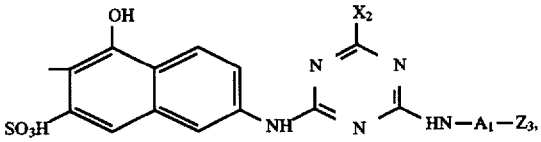
(25)
in which $Z_2$ and $Z_3$ are, independently of one another, hydrogen or radicals of the formulae
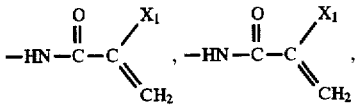

-continued $$-SO_2-CH=CH_2,\ -NH-\overset{O}{\overset{\|}{C}}-(CH_2)_3-SO_2-CH=CH_2,$$

$X_2$ is chlorine or fluorine, $X_1$ and $X_{1'}$, independently of one another, are hydrogen, chlorine, bromine or methyl, and $A_1$ is a direct bond, $-C_2H_4-O-C_2H_4-$, or

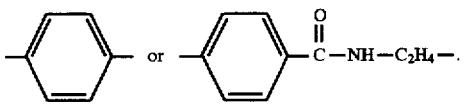

Suitable direct dyes are in particular phthalocyanine dyes, dioxazine dyes and dyes of the formula $$A_3-B_3-A_4 \quad (26a)$$

where $B_3$ in the dye of the formula (26a) is a bridging member and $A_3$ and $A_4$ are, independently of one another, the radical of a monoazo, polyazo, metal complex azo, stilbene or anthraquinone dye, or in which $B_3$ and $A_3$ are as defined and $A_4$ is a phenyl or naphthyl radical which is substituted by a heterocyclic radical or a benzoylamino or phenylamino radical or is a reactive group as defined above, or in which $B_3$ is a direct bond and $A_3$ and $A_4$ are each the radical of a metal complex azo dye, or dyes of the formula $$A_5-NH-L_1, \quad (26b)$$

in which $A_5$ is the chromophore radical of an organic dye and $L_1$ is a radical of the formulae $-CO-R_2$, $-SO_2-R_2$ or

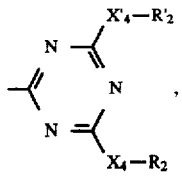

in which $X_4$ and $X_4'$ are, independently of one another, a direct bond, NH, NR, O or S, $R_2$ and $R_2'$ are, independently of one another, hydrogen, aromatic, aliphatic or cycloaliphatic radicals which are unsubstituted or substituted by halogen, OR", COOR", $SO_3H$ or aralkyl which is unsubstituted or substituted by halogen, OR", COOR" or $SO_3H$ where R" is hydrogen or $C_1$–$C_6$alkyl.

Examples of suitable bridging members for $B_3$ in formula (26a) are as follows:

$$-NH-, \quad (27a)$$

$$-\underset{R_{25}}{N}-\overset{O}{\overset{\|}{C}}-\underset{R_{25'}}{N}-, \quad (27b)$$

-continued $$-\underset{R_{25}}{N}-\overset{O}{\overset{\|}{C}}-X_3-\overset{O}{\overset{\|}{C}}-\underset{R_{25'}}{N}-, \quad (27c)$$

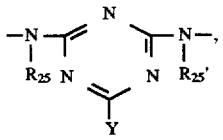

(27d)

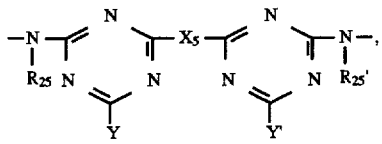

(27e)

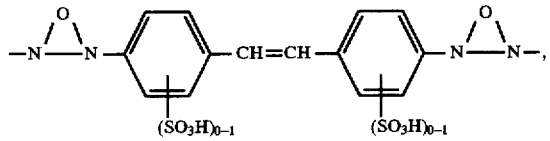

(27f)

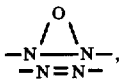

(27g)

$$-N=N- \quad (27h)$$

and $$-CH=CH-, \quad (27i)$$

in which $R_{25}$ and $R_{25'}$ are, independently of one another, substituted or unsubstituted $C_1$–$C_8$alkyl or, in particular, hydrogen, $X_3$ and $X_5$ are bridging members and Y and Y' are, independently of one another, hydroxyl, $C_1$–$C_4$alkoxy, chlorine, bromine, $C_1$–$C_4$alkylthio, amino, N-mono- or N,N-di-$C_1$–$C_4$alkylamino, each of which is unsubstituted or substituted in the alkyl portion by hydroxyl, sulfo, carboxyl or $C_1$–$C_4$alkoxy or is cyclohexylamino, phenylamino which is unsubstituted or substituted in the phenyl portion by $C_1$–$C_4$alkyl, $C_1$–$C_4$alkoxy, carboxyl, sulfo and/or halogen, or is N-$C_1$–$C_4$alkyl-N-phenylamino, morpholino or 3-carboxy- or 3-carbamoylpyridin-1-yl.

$R_{25}$ and $R_{25'}$ as $C_1C_8$alkyl can be unsubstituted or substituted, for example, by halogen, hydroxyl, cyano, $C_1$–$C_4$alkoxy, $C_1$–$C_4$alkoxycarbonyl, carboxyl, sulfamoyl, sulfo or sulfato.

$X_3$ as bridging member in formula (27c) is preferably an unsubstituted or hydroxyl-, sulfo-, sulfato-, $C_1C_4$alkoxy-, carboxyl- or halogen-substituted $C_2$–$C_6$alkylene or $C_5$–$C_9$cycloalkylene radical or an unsubstituted or $C_1$–$C_4$alkyl-, $C_1$–$C_4$alkoxy-, sulfo-, halogen- or carboxyl-substituted phenylene, biphenylene or naphthylene radical. $X_3$ is in particular unsubstituted or sulfo-substituted phenylene.

Examples of suitable bridging members $X_5$ in formula (27e) are the radicals of the formulae $$-NR_{25}-(CH_2)_{2-4}-NR_{25'}-, \quad (28a)$$

-continued (28b)

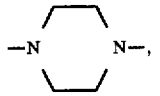

(28c)

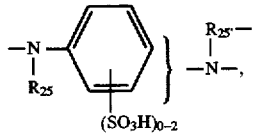

(28d)

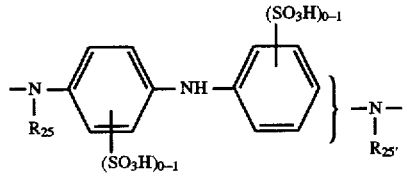

and in particular (28e)

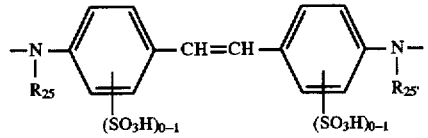

where $R_{25}$ and $R_{25'}$ have the abovementioned meanings and preferences. The radicals $R_2$ and $R_2'$ in the formula (26b) are preferably $C_1$–$C_6$alkyls or $C_1$–$C_6$alkylenes, for example methyl, ethyl and isopropyl, which may be unsubstituted or substituted, for example, by carboxyl or phenyl; furthemore, they are phenols which can also be substituted, for example, by carboxyl; substituted or unsubstituted benzyl radicals; and radicals of the formulae

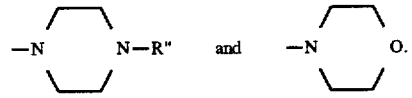

in which R" is as defined under formula (26b).

Particular preference is given to dyes of the formula (26a) in which $B_3$ and $A_3$ are as defined and $A_4$ is a phenyl radical substituted by benzothiazolyl, benzisothiazolyl or naphthotriazolyl where the phenyl radical and the benzothiazolyl, benzisothiazolyl and naphthotriazolyl substituents of the phenyl radical can be substituted, independently of one another, by $C_1$–$C_4$alkyl, $C_1$–$C_4$alkoxy, halogen, carboxyl, hydroxyl, sulfo, sulfamoyl, ureido, amino which may be further substituted by $C_1$–$C_4$alkyl or $C_1$–$C_4$hydroxyalkyl or by $C_2$–$C_6$alkanoyl or $C_2$–$C_6$alkanoylamino which may be further substituted in the alkyl portion by hydroxyl.

Particular preference is also given to the direct dyes of the formula (26b) in which $L_1$ is a radical of the formulae

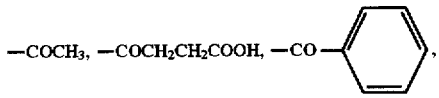

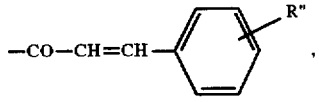

-continued

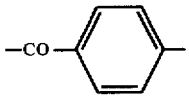

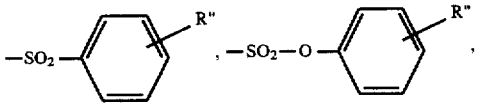

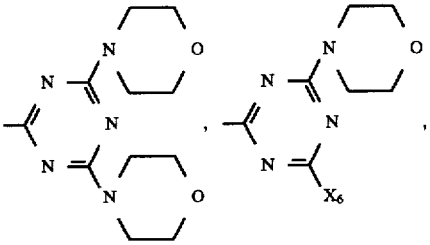

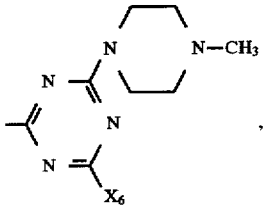

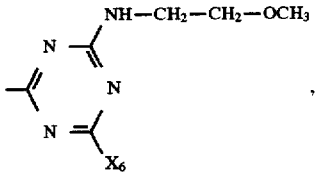

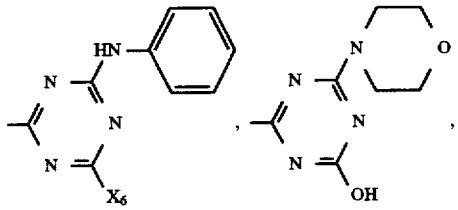

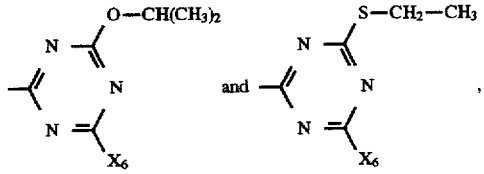

in which $X_6$ is halogen and

R" is as defined under formula (26b).

The reactive dyes and the direct dyes preferably contain at least one water-solubilizing group, such as a sulfo or sulfato group, in which case they are present either in the form of their free acid or preferably as their salts, for example their alkali metal salts, alkaline earth metal salts or ammonium salts or as the salts of an organic amine. Examples include sodium salts, potassium salts, lithium salts or ammonium salts or the salt of triethanolamine.

The reactive dyes and the direct dyes are known or can be prepared analogously to known dyes.

The cationic compounds to be used are advantageously colourless or almost colourless quaternary ammonium salts, additionally carrying at least one polymerizable double bond or are mixtures thereof. Preference is given to those of the general formula $$(R_{21}R_{22}R_{22'}R_{22''}N)_m^+(A)^{m-}, \quad (30)$$

in which $R_{21}$ is a radical of the formula $$CH_2{=}CX_7{-}Y_1{-}Q{-}, \quad (30a)$$

in which $X_7$ is hydrogen, $C_{1-2}$alkyl or halogen, $Y_1$ is —CO—O— or —CO—NH—, Q is $-CH_2-CHOH-CH_2-$, $-(CH_2)_w-$ or $-(CH_2-CH_2-O)_w-CH_2-CH_2-$, A is an anion from the group consisting of halides, sulfates, $C_{1-2}$alkyl sulfates, thiosulfates, phosphates, carboxylates and sulfonates, $R_{22}$, $R_{22'}$ and $R_{22''}$ are, independently of one another, hydrogen, $C_{1-24}$alkyl or $R_{21}$, or the quaternary nitrogen atom in formula (30) can also be a member of an N-heterocyclic ring which is substituted or unsubstituted and can contain further heteroatoms, m is 1, 2 or 3, and w is an integer between 1 and 20.

Quaternary ammonium salts which are particularly preferably used are those of the formula $$CH_2{=}CH{-}CO{-}O{-}CH_2{-}CH_2{-}N(CH_3)_3^+A^- \quad (30b)$$

$$CH_2{=}C(CH_3){-}CO{-}O{-}CH_2{-}CH_2{-}N(CH_3)_3^+A^- \quad (30c)$$

$$CH_2{=}C(CH_3){-}CO{-}NH{-}CH_2{-}CH_2{-}CH_2{-}N(CH_3)_3^+A^- \quad (30d)$$

or $$CH_2{=}C(CH_3){-}CO{-}O{-}CH_2{-}CHOH{-}CH_2{-}N(CH_3)_3^+A^- \quad (30e)$$

in which A is as defined above.

A further example of such quaternary compounds is the compound of the formula $$(CH_3)_2(CH_2{=}CHCH_2)_2N^+A^- \quad (30f).$$

Further auxiliaries include in particular colourless nonionic compounds containing at least one polymerizable double bond.

The colourless nonionic compounds containing at least one polymerizable double bond are free of colouring radicals. They are monomer, oligomer or polymer organic compounds or a mixture thereof which are capable of being polymerized or crosslinked.

A suitable monomer colourless compound is one having a molecular weight of up to about 1000 and containing at least one polymerizable group.

Bi-, tri- and polyfunctional monomers are also suitable.

The monomer colourless compound can either be used directly itself or as a mixture with other monomers, oligomers and/or polymers.

A suitable oligomer colourless compound is one having a molecular weight of between 1000 and 10,000 and containing one or more polymerizable groups. The oligomer colourless compound can be used directly itself, if it is a liquid, or as a solution in water or organic solvents or as a mixture with other monomers, oligomers and/or polymers.

A suitable polymer colourless compound is one having a molecular weight of >10,000 and containing one or more polymerizable groups.

The polymer colourless compound can be used directly itself, if it is a liquid, or as a solution in water or organic solvents or as a mixture with other monomers, oligomers and/or polymers.

Suitable colourless compounds include ethylenically unsaturated monomer, oligomer and polymer compounds.

Examples of particularly suitable compounds are esters of ethylenically unsaturated carboxylic acids and polyols or polyepoxides and polymers containing ethylenically unsaturated groups in the chain or in side groups, for example unsaturated polyesters, polyamides and polyurethanes and copolymers thereof, polybutadiene and butadiene copolymers, polyisoprene and isoprene copolymers, polymers and copolymers containing (meth)acrylic groups in side chains, and mixtures of one or more such polymers.

Examples of unsaturated carboxylic acids are acrylic acid, methacrylic acid, crotonic acid, itaconic acid, cinnamic acid and unsaturated fatty acids, such as linolenic acid or oleic acid. Preference is given to acrylic and methacrylic acid.

Suitable polyols are aliphatic and cycloaliphatic polyols. Examples of polyepoxides am those based on polyols and epichlorohydrin. Furthermore, polymers or copolymers containing hydroxyl groups in the polymer chain or in side groups, for example polyvinyl alcohol and copolymers thereof or poly(hydroxyalkyl methacrylates) or copolymers thereof, are also suitable polyols. Further suitable polyols are hydroxyl-terminated oligo esters.

Examples of aliphatic and cycloaliphatic polyols are alkylenediols preferably containing 2 to 12 C atoms, such as ethylene glycol, 1,2- or 1,3-propanediol, 1,2-, 1,3- or 1,4-butanediol, pentanediol, hexanediol, octanediol, dodecanediol, diethylene glycol, triethylene glycol, polyethylene glycols having molecular weights of preferably 200 to 1500, 1,3-cyclopentanediol, 1,2-, 1,3- or 1,4-cyclohexanediol, 1,4-dihydroxymethylcyclohexane, glycerol, tris(β-hydroxyethyl)amine, trimethylolethane, trimethylolpropane, pentaerythritol, dipentaerythritol and sorbitol.

The polyols can be partially or completely esterified with one or various unsaturated carboxylic acids, where the free hydroxyl groups in partial esters may be modified, for example esterified, or esterified with other carboxylic acids.

Examples of esters are:

trimethylolpropane triacrylate, trimethylolethane triacrylate, trimethylolpropane trimethacrylate, trimethylolethane trimethacrylate, tetramethylene glycol dimethacrylate, triethylene glycol dimethacrylate, tetraethylene glycol diacrylate, pentaerythritol diacrylate, pentaerythritol triacrylate, pentaerythritol tetraacrylate, dipentaerythritol diacrylate, dipentaerythritol triacrylate, dipentaerythritol tetraacrylate, dipentaerythritol pentaacrylate, dipentaerythritol hexaacrylate, tripentaerythritol octaacrylate, pentaerythritol dimethacrylate, pentaerythritol trimethacrylate, dipentaerythritol dimethacrylate, dipentaerythritol tetramethacrylate, tripentaerythritol octamethacrylate, pentaerythritol diitaconate, dipentaerythritol triitaconate, dipentaerythritol pentaitaconate, dipentaerythritol hexaitaconate, ethylene glycol dimethacrylate, 1,3-butanediol diacrylate, 1,3-butanediol dimethacrylate, 1,4-butanediol diitaconate, sorbitol triacrylate, sorbitol tetraacrylate, modified pentaerythritol triacrylate, sorbitol tetramethacrylate, sorbitol pentaacrylate, sorbitol hexaacrylate, oligoester acrylates and oligoester methacrylates, glycerol diacrylate and glycerol triacrylate, 1,4-cyclohexane diacrylate, bisacrylates and bismethacrylates of polyethylene glycol having a molecular weight of 200–1500, or mixtures thereof.

Suitable colourless compounds are also the amides of identical or different unsaturated carboxylic acids of aromatic, cycloaliphatic and aliphatic polyamines preferably having 2 to 6, in particular 2 to 4, amino groups. Examples of such polyamines are ethylenediamine, 1,2- or 1,3-propylenediamine, 1,2-, 1,3- or 1,4-butylenediamine, 1,5-pentylenediamine, 1,6-hexylenediamine, octylenediamine, dodecylenediamine, 1,4-diaminocyclohexane, isophoronediamine, phenylenediamine, bisphenylenediamine, di-β-aminoethyl ether, diethylenetriamine, triethylenetetramine, di-(β-aminoethoxy)- or di-(β-aminopropoxy)ethane. Further suitable polyamines are polymers and copolymers containing amino groups in the side chain and amino-terminated oligoamides.

Examples of such unsaturated amides are: methylenebisacrylamide, 1,6-hexamethylenebisacrylamide, diethylenetriaminetrismethacrylamide, bis(methacrylamidopropoxy)ethane, β-methacrylamidoethyl methacrylate, N[(β-hydroxyethoxy)ethyl]acrylamide.

Suitable unsaturated polyesters and polyamides are derived, for example, from maleic acid and diols or aliamines. The maleic acid can be replaced in part by other dicarboxylic acids. They can be used together with ethylenically unsaturated comonomers, for example styrene. The polyesters and polyamides can also be derived from dicarboxylic acids and ethylenically unsaturated diols or aliamines, in particular from longer-chain ones having, for example, 6 to 20 C atoms. Examples of polyurethanes are those which have been synthesized from saturated or unsaturated diisocyanates and unsaturated or saturated diols.

Polybutadiene and polyisoprene and copolymers thereof are known. Examples of suitable comonomers are olefins, such as ethylene, propene, butene, hexene, (meth)acrylates, acrylonitrile, styrene or vinyl chloride. Polymers containing (meth)acrylate groups in the side chain are also known. They can be, for example, reaction products of epoxy resins based on novolaks with (meth)acrylic acid, homo- or copolymers of polyvinyl alcohol or hydroxyalkyl derivatives thereof esterified with (meth)acrylic acid, or homo- and copolymers of (meth)acrylates esterified with hydroxyalkyl (meth) acrylates.

The colourless compounds can be used alone or in any desired mixtures.

Examples of suitable oligomer or polymer colourless compounds are preferably various polyester acrylates, for example $CH_2{=}CH{-}[CO{-}O(CH_2)_n]{-}CO{-}O{-}CH{=}CH_2$, epoxy acrylates, for example $(CH_2{=}CH{-}CO{-}O{-}CH_2{-}CHOH{-}CH_2{-}O{-}C_6H_4)_2C(CH_3)_2$, urethane acrylates, for example polyether acrylates, for example $$CH_2{=}CH{-}CO{-}O{-}[CH_2{-}\underset{\underset{CH_3}{|}}{CH}{-}O]_n{-}CO{-}O{-}CH{=}CH_2,$$

and silicone acrylates, such as known from Textilpraxis International (1987) pages 848–852.

In a preferred embodiment of the process according to the invention, the colourless compounds used are those containing an acrylic radical as the polymerizable group, particular preference being given to oligomer polyether acrylates, polyurethane acrylates and polyester acrylates.

The colourless compound used in the process according to the invention is in particular N-vinylpyrrolidine, acrylic acid, butyl acrylate, 2-ethylhexyl acrylate, 2-hydroxyethyl acrylate, hydroxypropyl acrylate, butanediol monoacrylate, 2-ethoxyethyl acrylate, ethylene glycol acrylate, butanediol acrylate, 2-ethoxyethyl acrylate, ethylene glycol acrylate, bisacrylates of polyethylene glycol having a molecular weight of 200 to 1500, butanediol diacrylate, tetraethylene glycol diacrylate, 1,6-hexanediol diacrylate, diethylene glycol diacrylate, dipropylene glycol diacrylate, triethylene glycol diacrylate, tripropylene glycol diacrylate, trimethylolpropane triacrylate, pentaerythritol triacrylate, bromoacrylamide, N-$C_{1-4}$alkylolacrylamide, N-butoxymethylacrylamide, N-isobutoxymethylacrylamide, N-$C_{1-4}$alkylolmethacrylamide, N-butoxymethylmethacrylamide, N-isobutoxymethylmethacrylamide, N,N-di($C_{1-4}$alkylol)acrylamide, N,N-di(butoxymethyl)acrylamide, N,N-di(isobutoxymethyl)acrylamide, N,N-di($C_{1-4}$methylol)methacrylamide, N,N-di(butoxymethyl)methacrylamide, N,N-di(isobutoxymethyl)methacrylamide, methylenebisdi(bromoacrylamide), methylenebisdiacrylamide, N-alkoxyacrylamide, tetraethylene glycol diacrylate, soya bean oil acrylate, polybutadiene acrylate, diethylene glycol dimethacrylate, 1,6-hexanediol dimethacrylate, 2-(2-ethoxyethoxy)ethyl acrylate, stearyl acrylate, tetrahydrofurfuryl acrylate, pentaerythritol tetraacrylate, lauryl acrylate, 2-phenoxyethyl acrylate, ethoxylated bisphenol diacrylate, ditrimethylolpropane tetraacrylate, triacrylate of tris-(2-hydroxyethyl)isocyanuric acid, isodecyl acrylate, dipentaerythritol pentaacrylate, ethoxylated trimethylolpropane triacrylate, isobornyl acrylate, ethoxylated tetrabromobisphenol diacrylate, propoxylated neopentylglycol diacrylate, propoxylated glyceryl triacrylate.

The colourless compounds preferably used in the process according to the invention are monomer, oligomer or polymer organic compounds or mixtures thereof.

The nonionic colourless compounds which are particularly preferably used in the process according to the invention are acrylates, diacrylates, triacrylates, polyacrylates, acrylic acid, methacrylates, dimethacrylates, trimethacrylates, polymethacrylates, methacrylic acid, acrylamide and acrylamides, diacrylamides, methacrylamide and methacrylamides and dimethacrylamides.

$$\begin{array}{l}
CH_2{=}CH{-}CO{-}O{-}CH_2CH_2{-}O{-}CO{-}NH{-}(CH_3){-}C_6H_3{-}NH{-}CO{-}O{-}(CH_2)_6{-}CO \\
\qquad\qquad\qquad Mixtures of monomer and oligomer colourless organic compounds are also particularly preferably used in the process according to the invention.

Very particular preference is given to the use of diacrylates of the general formula $$CH_2{=}CR_3{-}CO{-}O{-}(CH_2{-}CH_2{-}O)_v{-}CO{-}CR_3{=}CH_2 \quad (31)$$

in which $R_3$ is hydrogen or $C_{1-2}$alkyl and v is an integer between 1 and 12.

The cationic polymerizable compounds can be used in combination with one another or with the nonionic polymerizable compounds. Combinations of the quaternary salts of the formula $$CH_2{=}CH{-}CO{-}O{-}CH_2{-}CH_2{-}N(CH_3)_3^+A^- \quad (30b)$$

$$CH_2{=}C(CH_3){-}CO{-}O{-}CH_2{-}CH_2{-}N(CH_3)_3^+A^- \quad (30c)$$

$$CH_2{=}C(CH_3){-}CO{-}NH{-}CH_2{-}CH_2{-}CH_2{-}N(CH_3)_3^+A^- \quad (30d)$$

$$CH_2{=}C(CH_3){-}CO{-}O{-}CH_2{-}CHOH{-}CH_2{-}N(CH_3)_3^+A^- \quad (30e)$$

or $$(CH_3)_2(CH_2{=}CHCH_2)_2N^+A^- \quad (30f)$$

if desired with a bireactive acrylic compound of the formula $$CH_2{=}CCH_3{-}CO{-}O{-}(CH_2{-}CH_2{-}O)_{v'}{-}CO{-}CCH_3{=}CH_2 \quad (31a),$$

in which v' is 8 or 9, are preferably used.

The printing pastes and dyeing liquors can contain, in addition to the dye and the polymerizable compounds and a polymerization initiator, customary additives such as thickeners, dyeing assistants, fillers, dispersants, lubricating agents, antioxidants, antifoams and polymerization inhibitors. The latter are usually also added to the polymerizable compounds as stabilizers.

The process according to the invention can be applied to a wide range of fibres, for example fibres of animal origin, such as wools, silks, hair (for example in the form of felt) or semi-synthetic chemical fibres, such as protein fibres, fully synthetic fibres, such as polyvinyl, polyacrylonitrile, polyester, polyamide, aramid, polypropylene or polyurethane fibres and in particular cellulose-containing materials, such as bast fibres, for example linen, hemp, jute, ramie and, in particular, cotton, and synthetic cellulose fibres, such as viscose or modal fibres, cuprammonium, nitrocellulose or hydrolyzed acetate fibre or fibres made of cellulose acetate, such as acetate fibre, or fibres made of cellulose triacete, such as Arnel®, Trilan®, Courpleta®or Tricel®.

The fibres mentioned can be present in the forms used in particular in the textile industry, for example as filaments or yarns, or as woven fabrics, knitted fabrics or nonwoven materials, such as felt.

The fibre material preferably used in the process according to the invention is wool, silk, hair, polyvinyl, polyacrylonitrile, polyester, polyamide, aramid, polypropylene or polyurethane fibres or cellulose-containing fibres.

Cellulose fibres, polyester/cellulose blend fabrics and knitted fabrics and intimate polyester/cellulose fibre blends are particularly preferably used.

The treatment of the material to be dyed with a dye according to the definition can take place in the usual manner, for example, in the case of textile fabrics, by impregnation with a dye solution in an exhaust vat or by applying a padding solution by spraying or pad-dyeing, or by printing, for example, in a roller printing or film printing machine or by means of the ink-jet printing technique. The dye and the colourless cationic compounds and the polymerization initiator can be applied jointly as a homogeneous solution, suspension, emulsion or foam using customary methods. The dyed fibre material can be fixed while wet, moist or dry.

In general the colourless cationic compounds and the remaining additives are applied together with the dye to the material to be dyed. Alternatively, the colourless cationic compounds or the colourless cationic compounds and/or the polymerization initiator and, if used, further auxiliaries can be applied separately, for example in the form of an after-treatment.

The process is suitable in particular for carrying out continuous dyeing, printing and fixation processes, but the process or individual steps thereof can also be carried out batchwise.

The procedure of the process according to the invention is such that, for example, the textile substrate is dyed with a liquor containing a dye, at least one cationic acrylate and at least one thermal initiator and then subjected to a heat treatment, or that a dyeing is treated afterwards with at least one cationic acrylate and at least one thermal initiator and is then subsequently fixed by application of heat.

The dye concentrations of the dye solutions or printing pastes used can be selected as in conventional dyeing and printing methods, for example 0.001 to 20% by weight, relative to the fibre material used. The obtainable degrees of fixation are high, for example more than 90%. The process according to the invention usually produces dyeings having generally good properties, for example good wet- and light-fastness properties.

A preferred embodiment of the process according to the invention involves carrying out not only fixation of the corresponding dyes on the fibre material but also dyeing or printing continuously.

The invention also provides preparations comprising a dye, at least one colourless cationic compound containing at least one polymerizable double bond, at least one thermal polymerization initiator and, if desired, a colourless nonionic compound and a solubilizer. Preferred compositions contain those preferred individual components as discussed in the description of the dyes and of the colourless compounds. These compositions can contain further additives such as are customary for dyeing or printing. These compositions are also understood as meaning printing pastes suitable for emulsion printing.

Preference is given to preparations comprising (a) 5–30 parts by weight of a dye, (b) 5–70 parts by weight of a colourless cationic compound containing at least one polymerizable double bond, (c) 0.005–5 parts by weight of a thermal polymerization initiator, (d) 0–60 parts by weight of a nonionic colourless compound and (e) 0–10 parts by weight of a solubilizer, relative to 100 parts by weight of the preparation.

Particular preference is given to preparations comprising

10–20 parts by weight of component (a),

10–60 parts by weight of component (b), 0.01–2 parts by weight of component (c), 0–60 parts by weight of component (d) and 0–10 parts by weight of component (e), relative to 100 parts by weight of the preparation.

Very particular preference is given to preparations comprising 10 to 20 parts by weight of a dye as component (a), 10 to 60 parts by weight of a quaternary ammonium salt of the formula (30) as component (b), 0.01–2 parts by weight of an alkali metal peroxodisulfate as component (c), 0 to 60 parts by weight of an oligoethylene glycol diacrylate of the formula (31) as component (d) and 0 to 10 parts by weight of urea as component (e), relative to 100 parts by weight of the preparation.

In order to prepare a dyeing liquor or a printing paste, the concentrated preparations described can be diluted to any required dye concentration, it being possible for the nonionic colourless component (d), if not already present in the preparations, either to be added to the liquor in concentrations of 50–125 g/l or to be applied to the fibre material already beforehand in concentrations of 30–90 g/kg.

The examples which follow serve to illustrate the invention without limiting it thereto. Therein parts and percentages are by weight. The temperatures are given in degrees centigrade. Parts by weight relate to parts by volume as the gram relates to the cubic centimeter.

The degrees of fixation of the dye are determined via the dye content of the extracts obtained from a thermofixed stamped sample which has not been washed off and from a non-fixed stamped sample which has been dried at room temperature, both of which have a size of $(2.5\ cm)^2$. The samples are treated once at room temperature with 25 ml of a solution of 600 ml/l phosphate buffer (pH 7) and 40 ml/l tetramethylurea in desalted water for 20 minutes and then once at 100° C. with 25 ml of this solution for 20 minutes. The two extracts from each sample are combined and measured by spectroscopy. The degrees of fixation are determined from the extinctions (at $\lambda_{max}$) of the extracts of the corresponding stamped samples.

EXAMPLE 1

A cotton cretonne fabric is padded with an aqueous solution containing 30 g/l of the dye of the formula

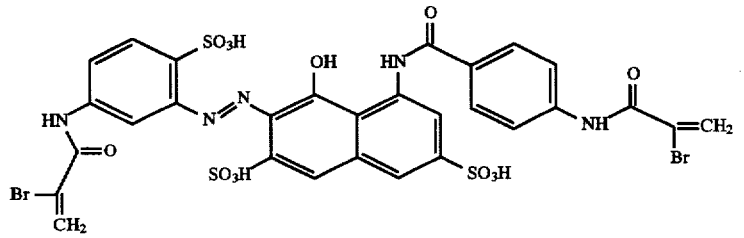

(100)

100 g/l of an oligoethylene glycol diacrylate having an average molecular weight of 508 g/mol.

85 g/l of $CH_2{=}CCH_3{-}CO{-}O{-}CH_2{-}CH_2{-}N(CH_3)_3{}^{\oplus}Cl^{\ominus}$, 20 g/l of $(NH_4)_2S_2O_8$ and 100 g/l of urea (liquor pickup about 70% ). The fabric is then treated in a thermofixation apparatus under the conditions listed in Table 1. This gives dyeings having the degrees of fixation given in Table 1.

TABLE 1

| Temperature [°C.] | Time [min] | Degree of fixation [%] |
|---|---|---|
| 110 | 6.0 | 91.1 |
| 130 | 2.0 | 93.2 |

EXAMPLE 2

Colour fastness to domestic and commercial laundering is determinated according to ISO standard 105/C06 C2. According to this test dyed pieces of cotton cretonne fabric in contact with specified adjacent fabrics are laundered, rinsed and dried. The change in colour of the cotton cretonne fabric and the staining of the adjacent fabrics are both assessed according to a 5 step grey scale, whereby a rating of 5 stands for no staining or no change in colour and a rating of 1 stands for a very strong staining or a significant change in colour.

A cotton cretonne fabric is padded with an aqueous solution containing 30 g/l of the dye of the formula (100), 80 g/l of $CH_2{=}CCH_3{-}CO{-}O{-}CH_2{-}CH_2{-}N(CH_3)_3{}^{\oplus}Cl^{\ominus}$ and 10 g/l of $(NH_4)_2S_2O_8$ (liquor pickup about 70% ). The fabric is then treated in a thermofixation apparatus at 130° C. for 3 minutes. This gives a red dyeing having the following fastness properties:

| Fastness Standard ISO 105/C06 C2 | |
|---|---|
| Altering or change in colour of cotton cretonne fabric | 3 |
| Soiling or staining of adjacent fabric | |
| CO (cotton) | 4 |
| CT (cellulose triacetate) | 5 |
| PA (polyamide) | 5 |
| PES (polyester) | 5 |
| PAC (polyacrylate) | 5 |

EXAMPLE 3

A cotton cretonne fabric is printed with a paste containing 30 g/kg of the dye of the formula (100), 80 g/kg of $CH_2{=}CCH_3{-}CO{-}O{-}CH_2{-}CH_2{-}N(CH_3)_3{}^{\oplus}Cl^{\ominus}$, 10 g/kg of $(NH_4)_2S_2O_8$ and 450 g/kg of an alginate thickener preparation using the screen printing method. The printed fabric is then treated in a thermofixation apparatus at 130° C. for 3 minutes. It is washed off with cold and hot water by the methods customary in reactive printing to give a red print.

EXAMPLE 4

A mercerized cotton cretonne fabric is padded with an aqueous solution containing 25 g/l of the dye of the formula

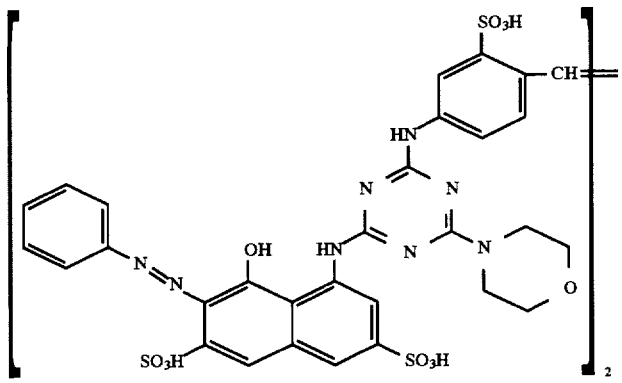

(101)

85 g/l of $CH_2=CCH_3—CO—O—CH_2—CH_2—N(CH_3)_3{}^{\oplus}C^{\ominus}$, 10 g/l of $Na_2S_2O_8$ (liquor pickup about 70% ). The fabric is then treated in a thermofixation apparatus at 130° C. for 3 minutes to give a red dyeing having the degree of fixation given in Table 2.

EXAMPLE 5

A mercerized cotton cretonne fabric is padded with an aqueous solution containing 25 g/l of the dye of the formula (101).

85 g/l of $CH_2=CCH_3—CO—O—CH_2—CH_2—N(CH_3)_3{}^{\oplus}Cl^{63}$ , 10 g/l of $(NH_4)_2S_2O_8$ and 100 g/l of an oligoethylene glycol diacrylate having an average molecular weight of 508 g/mol (liquor pickup about 70%). The fabric is then treated in a thermofixation apparatus at 130° C. for 3 minutes to give a red dyeing having the degree of fixation given in Table 2.

EXAMPLE 6

A mercerized cotton cretonne fabric is padded with an aqueous solution containing 25 g/l of the dye of the formula (101).

85 g/l of $CH_2=CCH_3—CO—O—CH_2—CH_2—N(CH_3)_3{}^{\oplus}Cl^{\ominus}$, 10 g/l of $(NH_4)_2S_2O_8$, 100 g/l of an oligoethylene glycol diacrylate having an average molecular of weight of 508 g/mol and 100 g/l of urea (liquor pickup about 70%). The fabric is then treated in a thermofixation apparatus at 130° C. for 3 minutes to give a red dyeing having the degree of fixation given in Table 2.

TABLE 2

| Example No. | Degree of fixation |
|---|---|
| 4 | 87% |
| 5 | 88% |
| 6 | 92% |

EXAMPLE 7

A mercerized cotton cretonne fabric is padded with an aqueous solution containing 20 g/l of the dye of the formula

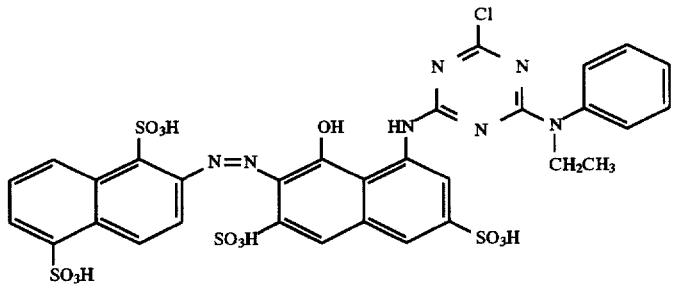

(102)

85 g/l of $CH_2=CCH_3—CO—O—CH_2—CH_2—N(CH_3)_3{}^{\oplus}Cl^{\ominus}$, 10 g/l of $Na_2S_2O_8$ (liquor pickup about 70% ). The fabric is then treated in a thermofixation apparatus at 130° C. for 3 minutes to give a red dyeing having the degree of fixation given in Table 3.

EXAMPLE 8

A mercerized cotton cretonne fabric is padded with an aqueous solution containing 20 g/l of the dye of the formula (102).

85 g/l of $CH_2=CCH_3—CO—O—CH_2—CH_2—N(CH_3)_3{}^{\oplus}Cl^{\ominus}$, 10 g/l of $(NH_4)_2S_2O_8$ and 100 g/l of an oligoethylene glycol diacrylate having an average molecular weight of 508 g/mol (liquor pickup about 70%). The fabric is then treated in a thermofixation apparatus at 130° C. for 3 minutes to give a red dyeing having the degree of fixation given in Table 3.

EXAMPLE 9

A mercerized cotton cretonne fabric is padded with an aqueous solution containing 20 g/l of the dye of the formula (102).

85 g/l of $CH_2{=}CCH_3{-}CO{-}O{-}CH_2{-}CH_2{-}N(CH_3)_3^{\oplus}Cl^{\ominus}$, 10 g/l of $(NH_4)_2S_2O_8$, 100 g/l of an oligoethylene glycol diacrylate having an average molecular weight of 508 g/mol and 100 g/l of urea (liquor pickup about 70%). The fabric is then treated in a thermofixation apparatus at 130° C. for 3 minutes to give a red dyeing having the degree of fixation given in Table 2.

TABLE 3

| Example No. | Degree of fixation |
|---|---|
| 7 | 66% |
| 8 | 87% |
| 9 | 91% |

What is claimed is:

1. A process for dyeing or printing organic material, which comprises applying at least one dye selected from those containing a chromophore radical from the monoazo, polyazo, metal complex azo, anthraquinone, phthalocyanine, formazan, azomethine, nitroaryl, dioxazine, phenazine, stilbene, triphenylmethane, xanthene, thioxanthone, naphthoquinone, pyrenequinone or perylene-tetracarbamide series which contains an acrylamide, methacrylamide, bromoacrylamide or chloroacrylamide reactive group, at least one colourless cationic compound containing at least one polymerizable double bond, and at least one polymerization initiator and optionally further auxiliaries to the organic material and then subjecting it to thermofixation.

2. A process according to claim 1, wherein 0.005 to 20% by weight of an aliphatic azo compound or of an inorganic or organic peroxo compound, relative to the total amount of the polymerizable colourless compounds, is used as the polymerization initiator.

3. A process according to claim 1, wherein a quaternary ammonium salt additionally containing at least one polymerizable double bond is used as the colourless cationic compound.

4. A process according to claim 3, wherein the colourless cationic compound is a quaternary ammonium salt of the formula $$(R_{21}R_{22}R_{22'}R_{22''}N)_m^{+}(A)^{m-}, \quad (30)$$

in which $R_{21}$ is a radical of the formula $$CH_2{=}CX_7{-}Y_1{-}Q{-} \quad (30a)$$

in which $X_7$ is hydrogen, $C_{1-2}$alkyl or halogen, $Y_1$ is a direct bond, —CO—O— or —CO—NH—, Q is $-CH_2-CHOH-CH_2-$, $-(CH_2)_w-$ or $-(CH_2-CH_2-O)_w-CH_2CH_2-$, A is an anion selected from the group consisting of halides, sulfates, $C_{1-2}$alkyl sulfates, thiosulfates, phosphates, carboxylates and sulfonates, $R_{22}$, $R_{22'}$ and $R_{22''}$ are, independently of one another, hydrogen, $C_{1-24}$alkyl or $R_{21}$, or the quaternary nitrogen atom in formula (30) can also be a member of an N-heterocyclic ring which can be substituted or unsubstituted and can contain further heteroatoms, m is 1, 2 or 3 and w is an integer between 1 and 20.

5. A process according to claim 4, wherein the colourless cationic compound is a quaternary ammonium salt of the formula $$CH_2{=}CH{-}CO{-}O{-}CH_2{-}CH_2{-}N(CH_3)_3^{+}A^{-} \quad (30b)$$

$$CH_2{=}C(CH_3){-}CO{-}O{-}CH_2{-}CH_2{-}N(CH_3)_3^{+}A^{-} \quad (30c)$$

$$CH_2{=}C(CH_3){-}CO{-}NH{-}CH_2{-}CH_2CH_2{-}N(CH_3)_3^{+}A^{-} \quad (30d)$$

$$CH_2{=}C(CH_3){-}CO{-}O{-}CH_2{-}CHOH{-}CH_2{-}N(CH_3)_3^{+}A^{-} \quad (30e)$$

or $$(CH_3)_2(CH_2{=}CHCH_2)_2N^{+}A^{-} \quad (30f)$$

in which A is an anion selected from the group consisting of halides, sulfates, $C_{1-2}$alkyl sulfates, thiosulfates, phosphates, carboxylates and sulfonates.

6. A process according to claim 1, wherein a colourless nonionic compound containing at least one polymerizable double bond is used as a further auxiliary.

7. A process according to claim 6, wherein the colourless nonionic compound is selected from the group consisting of acrylates, methacrylates, acrylamides and methacrylamides.

8. A process according to claim 7, wherein the colourless nonionic compound is a diacrylate of the formula $$CH_2{=}CR_3{-}CO{-}O{-}(CH_2{-}CH_2{-}O)_v{-}CO{-}CR_3{=}CH_2 \quad (31),$$

in which $R_3$ is hydrogen or $C_{1-2}$alkyl and v is an integer between 1 and 12.

9. A process according to claim 2, wherein 5 to 12% by weight of an aliphatic azo compound or of an inorganic or organic peroxo compound, relative to the total amount of the polymerizable colourless compounds, is used as the polymerization initiator.

10. A process according to claim 1, wherein the dye contains at least two acrylamide, methacrylamide, bromoacrylamide and chloroacrylamide reactive groups which are independent of one another.

11. A process according to claim 2, wherein the polymerization initiator used is 2,2'-azobis(2-methylpropiohydroxamic acid), 2,2'-azobis(2-methylpropionohydrazide), 2,2'-azobis(2-amidinopropane)dihydrochloride, 2,2'-azobis[2-(N-phenylamidino)propane]dihydrochloride or sodium perborate.

12. A process according to claim 2, wherein the polymerization initiator used is a compound from the group consisting of alkali metal peroxodisulfates.

13. A process according to claim 2, wherein the polymerization initiator used is sodium peroxodisulfate, potassium peroxodisulfate, ammonium peroxodisulfate, sodium percarbonate or 4,4'-azobis(4-cyanopentanoic acid).

14. A process according to claim 1, wherein heat treatment, steaming or high-temperature steaming is used for the thermofixation.

15. A process according to claim 1, wherein thermofixation takes place in a temperature range from 70° to 230° C.

16. A process according to claim 1, wherein the duration of thermofixation is 1 to 10 minutes.

17. A process according to claim 1, wherein the organic material used is a fibre material.

18. A process according to claim 1, wherein printing is carried out by means of an ink-jet printer.

19. A process according to claim 1, wherein fixation is carried out continuously.

20. A process according to claim 18, wherein not only dyeing or printing but also fixation of the dyes on the fibre material are carried out continuously.

21. A process according to claim 17, wherein the fibre material is wool, silk, hair, polyvinyl, polyacrylonitrile, polyester, polyamide, polypropylene fibres, polyurethane fibres, cellulose-containing fibres or glass fibres.

22. A process according to claim 21, wherein cellulose fibres, polyester/cellulose blend fabrics and knitted fabrics and intimate polyester/cellulose fibre blends are used.

23. A process according to claim 1, wherein at least one dye is applied to the organic material together with at least one colourless cationic compound containing at least one polymerizable double bond, and at least one polymerization initiator and, optionally, further auxiliaries and then subjected to thermofixation.

24. A process according to claim 17, wherein the fibre material is first dyed with dyes and then a colourless cationic compound containing at least one polymerizable double bond and optionally further auxiliaries are applied to the fibre material and subjected to thermofixation.

25. A preparation comprising (a) 5–30 parts by weight of a dye selected from those containing a chromophore radical from the monoazo, polyazo, metal complex azo, anthraquinone, phthalocyanine, formazan, azomethine, nitroaryl, dioxazine, phenazine, stilbene, triphenylmethane, xanthene, thioxanthone, naphthoquinone, pyrenequinone or perylenetetracarbamide series which contains an acrylamide, methacrylamide, bromoacrylamide or chloroacrylamide reactive group, (b) 5–70 part by weight of a colourless cationic compounds containing at least one polymerisable double bond, (c) 0.005–5 parts by weight of a thermal polymerization initiator, (d) 0–60 parts by weight of a nonionic colourless compound and (e) 0–10 parts by weight of a solubiliser, relative to 100 parts by weight of the preparation.

26. A preparation according to claim 25 comprising 10 to 20 parts by weight of a dye selected from those containing a chromophore radical from the monoazo, polyazo, metal complex azo, anthraquinone, phthalocyanine, formazan, azomethine, nitroaryl, dioxazine, phenazine, stilbene, triphenylmethane, xanthene, thioxanthone, naphthoquinone, pyrenequinone or perylenetetracarbamide series which contains an acrylamide, methacrylamide, bromoacrylamide or chloroacrylamide reactive group, 10 to 60 parts by weight of a quaternary ammonium salt of the formula $$(R_{21}R_{22}R_{22'}R_{22''}N)_m^+(A)^{m-}, \quad (30)$$

in which $R_{21}$ is a radical of the formula $$CH_2{=}CX_7{-}Y_1{-}Q{-}, \quad (30a)$$

in which $X_7$ is hydrogen, $C_{1-2}$alkyl or halogen, $Y_1$ is —CO—O— or —CO—NH—, Q is $-CH_2-CHOH-CH_2-$, $-(CH_2)_w-$ or $-(CH_2-CH_2-O)_w-CH_2-CH_2-$, A is an anion selected from the group consisting of halides, sulfates, $C_{1-2}$alkyl sulfates, thiosulfates, phosphates, carboxylates and sulfonates, $R_{22}$, $R_{22'}$ and $R_{22''}$ are, independently of one another, hydrogen, $C_{1-24}$alkyl or $R_{21}$, or the quaternary nitrogen atom in formula (30) is a member of an N-heterocyclic ring which can be substituted or unsubstituted and can contain further heteroatoms, m is 1, 2 or 3 and w is an integer between 1 and 20, 0.01—parts by weight of an alkali metal peroxodisulfate 0 to 60 parts by weight of an oligoethylene glycol diacrylate of the formula $$CH_2{=}CR_3{-}CO{-}O{-}(CH_2{-}CH_2{-}O)_v{-}CO{-}CR_3{=}CH_2, \quad (31)$$

in which $R_3$ is hydrogen or $C_{1-2}$alkyl and v is an integer between 1 and 12 and 0 to 10 parts by weight of urea, relative to 100 parts by weight of the preparation.

* * * * *